US008528754B2

(12) United States Patent
Noniewicz et al.

(10) Patent No.: US 8,528,754 B2
(45) Date of Patent: Sep. 10, 2013

(54) SAW HORSE

(75) Inventors: Zbigniew Noniewicz, Kempenich (DE); Hans-Jürgen Schüller, Koenigsfeld (DE)

(73) Assignee: Wolfcraft GmbH, Kempenich (DE)

( * ) Notice: Subject to any disclaimer, the term of this patent is extended or adjusted under 35 U.S.C. 154(b) by 47 days.

(21) Appl. No.: 13/119,058

(22) PCT Filed: Sep. 11, 2009

(86) PCT No.: PCT/EP2009/061801

§ 371 (c)(1),
(2), (4) Date: Mar. 15, 2011

(87) PCT Pub. No.: WO2010/034629

PCT Pub. Date: Apr. 1, 2010

(65) Prior Publication Data

US 2011/0180505 A1 Jul. 28, 2011

(30) Foreign Application Priority Data

Sep. 26, 2008 (DE) ..... 10 2008 037 398

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 7/00*** | (2006.01) |

(52) U.S. Cl.
USPC ..... 211/195; 211/49.1

(58) Field of Classification Search
USPC ..... 211/49.1, 60.1, 85.31, 41.4, 41.5, 211/41.6, 195, 201, 202, 181.1, 24, 70.4, 211/188, 194; 248/146, 153, 671; 182/181.1, 182/153; 220/6, 7, 666
See application file for complete search history.

(56) References Cited

U.S. PATENT DOCUMENTS 732,037 A * 6/1903 Best ..... 294/167
1,393,054 A * 10/1921 Turner ..... 211/60.1

(Continued)

FOREIGN PATENT DOCUMENTS

BE 897243 A1 11/1983
DE 8509792 U1 7/1985

(Continued)

OTHER PUBLICATIONS

Machine Translation of DE 3511964.*

(Continued)

*Primary Examiner* — Darnell Jayne
*Assistant Examiner* — Kimberley S Wright
(74) *Attorney, Agent, or Firm* — Lucas & Mercanti, LLP; Klaus P. Stoffel

(57) ABSTRACT

The patent application relates to a saw horse having at least two stand elements, each stand element (1) having a base (4) and two vertical braces (2) which in each case leave an interspace (5) between one another for accommodating wood (21) to be sawed or the like, and which project upwardly from the base (4). One vertical brace (2) of one stand element (1) is connected to a vertical brace (2) of the other stand element (1) via a connecting element (6) in such a way that the interspaces (5) of the two stand elements (1) are aligned with one another in an operating position in which the connecting elements (6) extend parallel to one another. In order to achieve a refinement that is advantageous for use, it is proposed that the connecting elements (6) are pivotably secured to the vertical braces (2) so that the saw horse may be folded up in a parallelogram-like manner from its operating position, in which the connecting elements (6) are spaced at a maximum distance from one another, into a storage position in which the connecting elements (6) are spaced at a minimum distance from one another.

17 Claims, 5 Drawing Sheets

(56) References Cited

U.S. PATENT DOCUMENTS

| | | | | | |
|---|---|---|---|---|---|
| 1,655,593 | A | * | 1/1928 | Bulman | 211/195 |
| 1,742,637 | A | * | 1/1930 | Dearborn | 182/153 |
| 2,646,174 | A | * | 7/1953 | Hutten et al. | 211/44 |
| 2,791,336 | A | * | 5/1957 | Stairwalt | 211/149 |
| 2,859,066 | A | * | 11/1958 | Franklin | 182/225 |
| 2,874,003 | A | * | 2/1959 | Humphries | 182/153 |
| 2,913,125 | A | * | 11/1959 | Burtenshaw | 211/60.1 |
| 3,091,348 | A | * | 5/1963 | Neuhauser | 206/391 |
| 3,177,974 | A | * | 4/1965 | Martin et al. | 182/155 |
| 3,388,771 | A | * | 6/1968 | Corneliusen | 182/153 |
| 3,392,682 | A | * | 7/1968 | Francis | 410/42 |
| 4,333,574 | A | * | 6/1982 | Christy, Sr. | 211/60.1 |
| 4,454,929 | A | * | 6/1984 | Wellman | 182/154 |
| 4,997,151 | A | | 3/1991 | Pai | |
| 5,028,062 | A | * | 7/1991 | Pinnell et al. | 280/47.34 |
| 5,297,655 | A | * | 3/1994 | Wolfe | 182/153 |
| 5,439,152 | A | * | 8/1995 | Campbell | 224/405 |
| 5,678,811 | A | * | 10/1997 | Johnson | 269/237 |
| 5,934,659 | A | * | 8/1999 | Johnson | 269/237 |
| 5,941,398 | A | * | 8/1999 | Harris | 211/60.1 |
| 5,954,156 | A | * | 9/1999 | Cooke | 182/153 |
| 6,036,032 | A | * | 3/2000 | Moscatelli | 211/60.1 |
| 6,290,073 | B1 | * | 9/2001 | Barnes et al. | 211/60.1 |
| 6,851,564 | B2 | * | 2/2005 | Ng | 211/149 |
| 6,929,096 | B1 | * | 8/2005 | Goldberg | 182/181.1 |
| 6,997,332 | B1 | * | 2/2006 | Alexander et al. | 211/60.1 |
| RE41,763 | E | * | 9/2010 | Ng | 211/149 |
| 8,033,768 | B2 | * | 10/2011 | Anderson | 410/49 |
| 2006/0016311 | A1 | * | 1/2006 | Seymour | 83/651 |
| 2006/0091096 | A1 | * | 5/2006 | Velez et al. | 211/194 |
| 2008/0053928 | A1 | * | 3/2008 | Klauer | 211/49.1 |

FOREIGN PATENT DOCUMENTS

| | | | |
|---|---|---|---|
| DE | 3511964 | A1 | 10/1986 |
| DE | 20217429 | U1 | 1/2003 |
| FR | 2523027 | A1 | 9/1983 |
| FR | 2685658 | A1 | 7/1993 |
| GB | 2290955 | A | 1/1996 |

OTHER PUBLICATIONS

Espace Machine Translation "Description BE897243", retrieved from http://translationportal.epo.org/, retreived Feb. 7, 2013.*

European Search Report issued for EP Patent Application No. 11160854 corresponding to PCT/EP2009/061801 dated Jun. 9, 2011.

* cited by examiner 10
5
10
2
2
1
16
18
2
19
5
17
11
11
11'
8
11
13
12
4
20
3
7
14
12
14
6
12

SAW HORSE

CROSS-REFERENCE TO RELATED APPLICATIONS

This application is a 371 of PCT/EP2009/061801 filed on Sep. 11, 2009, which claims the benefit of German Application No. 102008037398.2 filed on Sep. 26, 2008, the contents of each of which are incorporated herein by reference.

The invention relates to a saw horse having at least two stand elements, each stand element having a base and two vertical braces which in each case leave an interspace between one another for accommodating wood to be sawed or the like, and which project upwardly from the base, one vertical brace of one stand element being connected in the region of the base to a vertical brace of the other stand element via a connecting element in such a way that the interspaces of the two stand elements are aligned with one another in an operating position in which the connecting elements extend parallel to one another.

Such a saw horse is known in the prior art. The saw horse has two stand elements which are approximately structurally identical, each stand element having two vertical stanchions which are arranged in a forked manner. The vertical braces extending in parallel are rooted in a base that forms support legs on which the saw horse stands. A total of two stand elements are provided, which in an operating position are associated with one another in such a way that the interspaces between the respective vertical stanchions are aligned with one another, so that wood logs may be layered between the vertical braces/stanchions of the respective stand elements. In the saw horse known in the prior art, additional retaining elements which likewise form vertical braces are located between the two stand elements. A multiplicity of wood logs may be stacked between the vertical braces of the retaining elements and the vertical braces of the stand elements. Thus, a multiplicity of logs may be split up in a single step, using a chainsaw. The logs lying at the very bottom rest on horizontally extending support bars which extend between the two vertical braces.

It is an object of the invention to refine the saw horse described at the outset.

The object is achieved by the invention specified in the claims, each claim basically representing an independent achievement of the object. It is first and primarily provided that the connecting elements are pivotably secured to the vertical braces so that the saw horse may be folded up in a parallelogram-like manner from its operating position, in which the connecting elements situated in the region of the base are spaced at a maximum distance from one another, into a storage position in which the connecting elements are spaced at a minimum distance from one another. The stand elements as well as the connecting elements each remain in a parallel position with respect to one another when the saw horse is folded up. In a refinement of the invention, it is provided that the saw horse is held in its operating position by means of a releasable positive-fit detent. The positive-fit detent may be formed by a detent recess in the connecting element. In the operating position, the engagement portion of the base lies in this detent recess. The positive-fit detent may be easily overcome by moving the connecting elements upwardly. The detent recess is open at the bottom. A detent engagement portion of the base lies in the detent recess. The detent connection is held by the force of gravity. The articulated joint via which the connecting element is connected to the vertical brace is axially movable, so that the connecting element, which is preferably a wooden board, may be moved upwardly relative to the stand element so that the two detent elements are disengaged. In a preferred refinement of the invention, a retaining element is located between the two stand elements. The retaining element likewise provides vertical braces. In the operating position, the vertical braces which are respectively associated with a connecting element are aligned with one another, so that an interspace remains between the vertical braces of one stand element or one retaining element, in which the logs may be layered. The retaining element is likewise pivotably secured to the connecting element. However, the articulated joint in this case is preferably axially fixed. The detent connection may thus be overcome by lifting a retaining element situated between the two stand elements. In a refinement of the invention, it is provided that the interspace between the two vertical braces of one stand element and/or one retaining element is bridged by a support bar. The support bars extend at the same height, so that in particular the support bar of the retaining element is subjected to downward load by the logs lying thereon. The detent engagement between the connecting element and the base of the stand element is thus strengthened due to the axially fixed articulated joint. In a refinement of the invention, it is provided that the support bars extend between the vertical braces, while forming a substantially V-shaped depression. The support bars are preferably V-shaped, bent tubes which at their end faces are welded to the side walls of the vertical braces, these likewise being formed by tubes. The lower ends of the vertical braces are connected to a horizontal brace. This horizontal brace may likewise be formed by a tube. The horizontal brace may have end portions which form oblique, downwardly angled support legs. A hold-down element is provided which is mountable on one of the vertical braces. For this purpose the hold-down element, which is preferably formed by a sheet metal strip bent into a U shape, has an eye on one side. The other end of the hold-down element is able to form only a fork, the other vertical brace of the retaining element or of the stand element lying in the fork interspace. Toothing may be provided at the two border edges of the U leg. In addition, one or more measuring scales are provided which extend parallel to the connecting elements and which are preferably secured to the vertical braces in a height-adjustable manner.

The lowermost vertices of the support bars are vertically spaced at a distance above the upper edge of the connecting elements.

As a result of this spacing, there is sufficient room for the saw blade of a chainsaw to move into, with which chainsaw a pile of wood stacked in the interspace between the vertical braces may be split up in the region between the stand element and the retaining element. The cut is made from top to bottom. The wood situated in the interspace may thus be cut multiple times between the stand elements, but also outside the stand elements, without having to move the individual wood pieces. By means of the measuring scale mounted on the vertical braces, the starting point for setting the saw blade may be easily selected so that portions of equal length may be sawed.

One exemplary embodiment of the invention is explained below with reference to accompanying drawings, which show the following:

Figure 1:
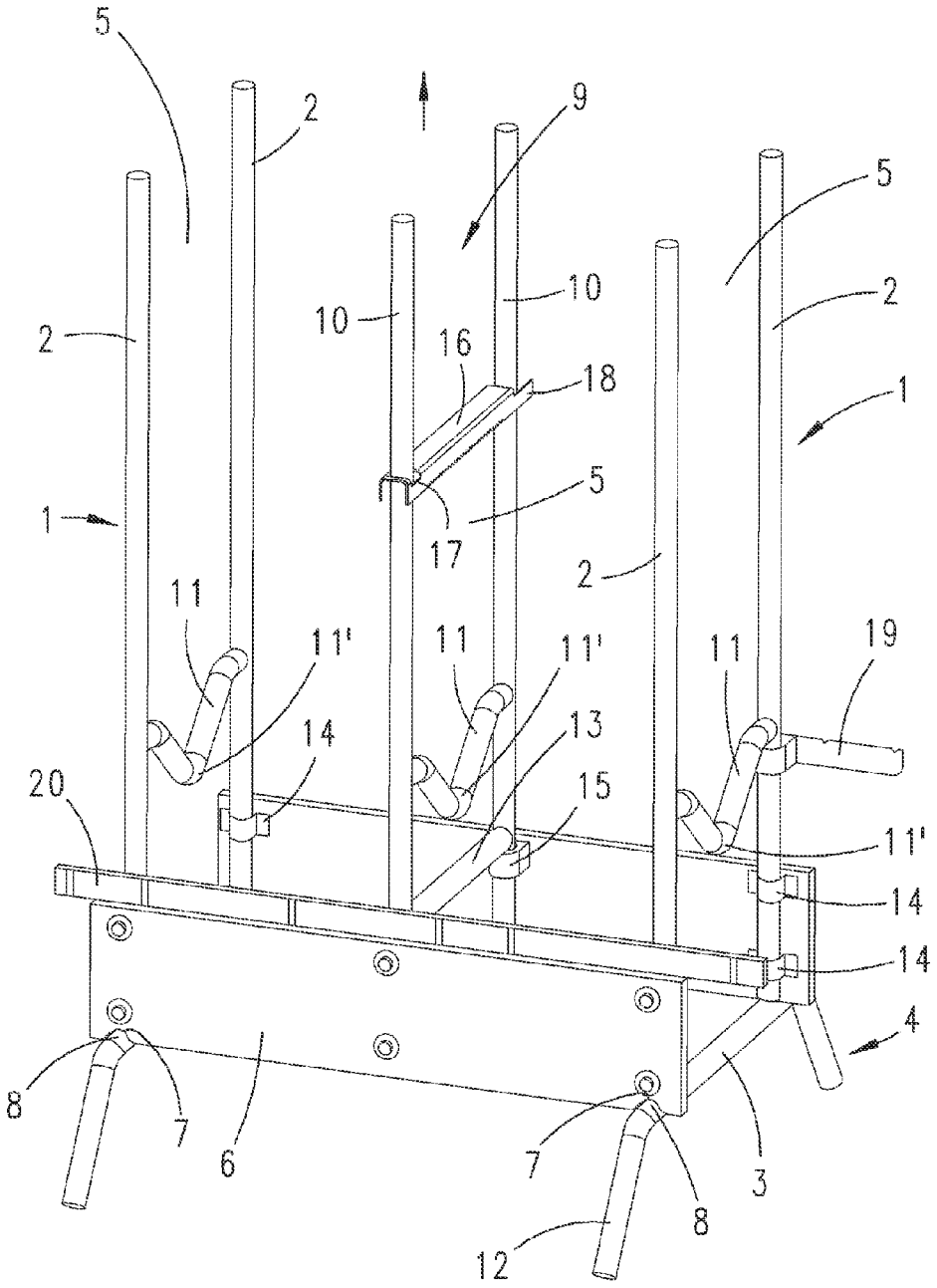
FIG. 1 shows a perspective illustration of a saw horse in an operating position.
Figure 2:
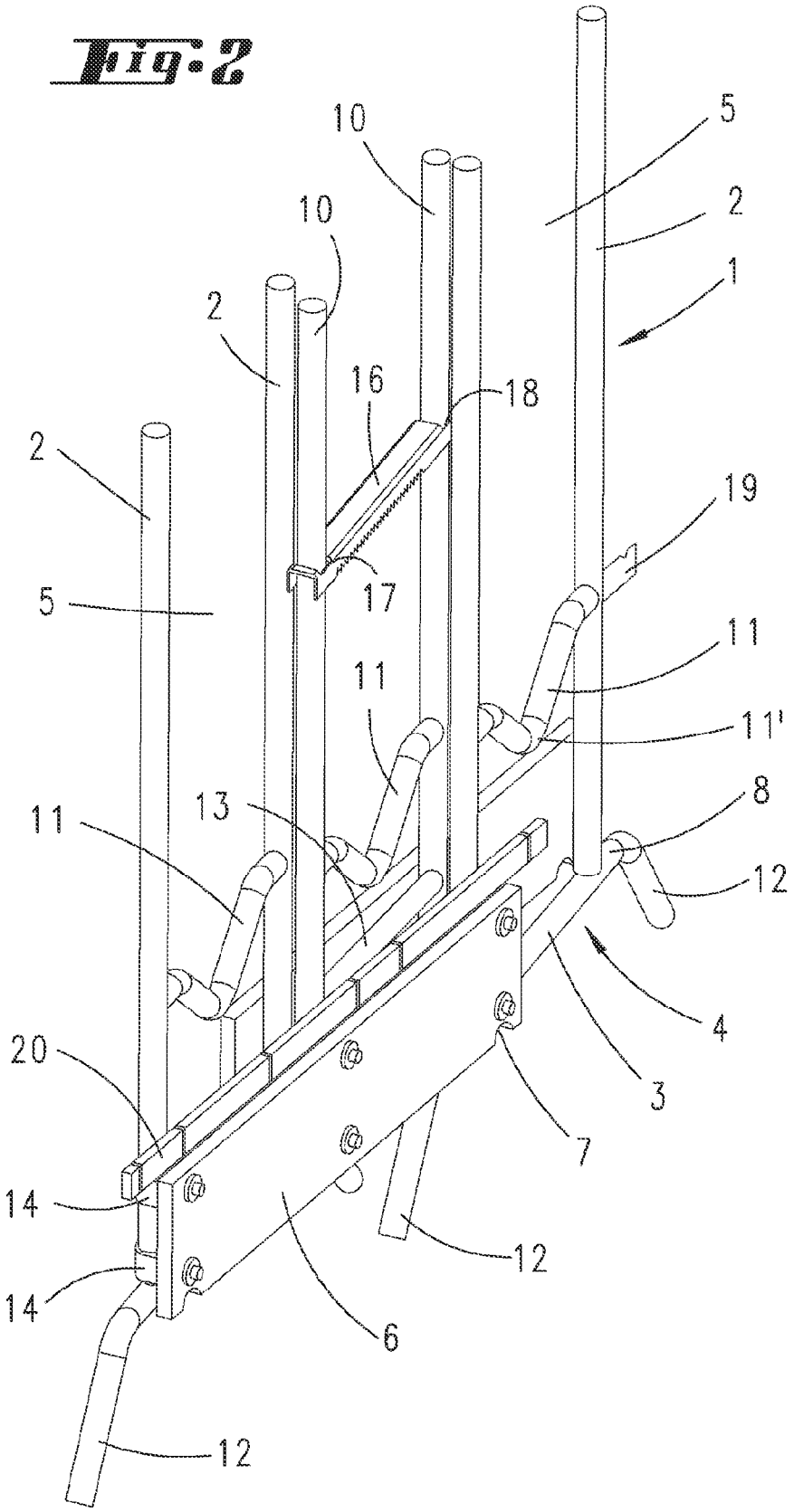
FIG. 2 shows the saw horse according to FIG. 1 in a folded-up storage position.

The saw horse illustrated in the drawings is composed essentially of two structurally identical stand elements 1. The stand elements 1 have a tubular construction. A first tube forms a base 4. This tube has a horizontal portion 3 and end portions 12, projecting at an obtuse angle therefrom, which form the support legs.

Two vertical braces 2 spaced at a distance from one another project perpendicularly upwardly from the horizontal brace 3. The free ends of the vertical braces 2 are not connected to one another, so that the vertical braces 2 have a forked shape. The vertical braces 2 extend parallel to one another, and are connected to one another by a V-shaped tube piece 11 slightly above the horizontal brace 3. The tube piece 11 forms a support bar having a downwardly pointing V-shaped vertex 11'.

Two such stand elements 1 are connected to one another directly above the base 4 via two connecting elements 6 which extend parallel to one another. The connecting elements 6 are oblong, rectangular wooden boards which carry articulated joints 14, 15. One end of each connecting element 6 is pivotably connected to the lower portion of a vertical brace 2 via two articulated joints 14. The articulated joints 14 are axially movable articulated joints, so that the vertical brace 2 may be displaced relative to the connecting element 6 along the pivot axis.

Thus, in the top view, this results in a parallelogram-like structure with respect to the horizontal braces 3 and the connecting elements 6.

In the region of the articulated joints 14, the two connecting elements 6 have arc-shaped detent recesses 7 at their lower side. In the operating position, detent engagement portions 8 of the base 4 lie in these detent recesses 7. The detent engagement portions 8 are formed by the tube portions 8 of the horizontal brace 3 located on the other side from the vertical braces 2.

A retaining element 9 is located approximately midway between the two stand elements 1. The retaining element 9 likewise has a tubular construction, and has two vertical braces 10 extending parallel to one another in the vertical direction. The vertical braces 2, 10 associated with a respective connecting element 6 are aligned with one another, so that the interspaces 5 between the vertical braces 2, 10 of the stand elements 1 or of the retaining element 9 are also aligned with one another.

The retaining element 9 is connected to the connecting element 6 via articulated joints 15. Here as well, each vertical brace 10 of the retaining element 9 is connected to the connecting element 6 via two articulated joints 15. These articulated joints 15 are axially fixed. As a result, lifting the retaining element 9 also causes the detent between the detent recess 7 and the detent engagement portion 8 to be overcome, since the two connecting elements 6 are carried along when the retaining element 9 is moved upwardly.

The retaining element 9 likewise has a support bar 11 which extends at the same height and has the same configuration as the support bars 11 of the stand elements 1.

The two vertical braces 10 of the retaining element 9 are connected to one another below the support bar 11 via a horizontal brace 13. The horizontal brace 13 extends directly above the axially fixed articulated joint 15.

A hold-down element is denoted by reference numeral 16. The hold-down element is composed of a sheet metal strip which is bent into a U shape. An eye 17 is provided at one end of the U-shaped sheet metal strip. A fork 18 is provided at the end opposite from the eye 17. A vertical brace 2, 10 may be inserted into the eye 17 of the hold-down element 16. The respective other vertical brace 2, 10 then lies inside the fork 18. The eye 17 is formed in such a way that the hold-down element 16 is able to tilt at the vertical brace 6 passing through the eye 17 of the hold-down element. This allows downward pressure to be applied to the wood logs situated in the interspace 5.

Figure 4:
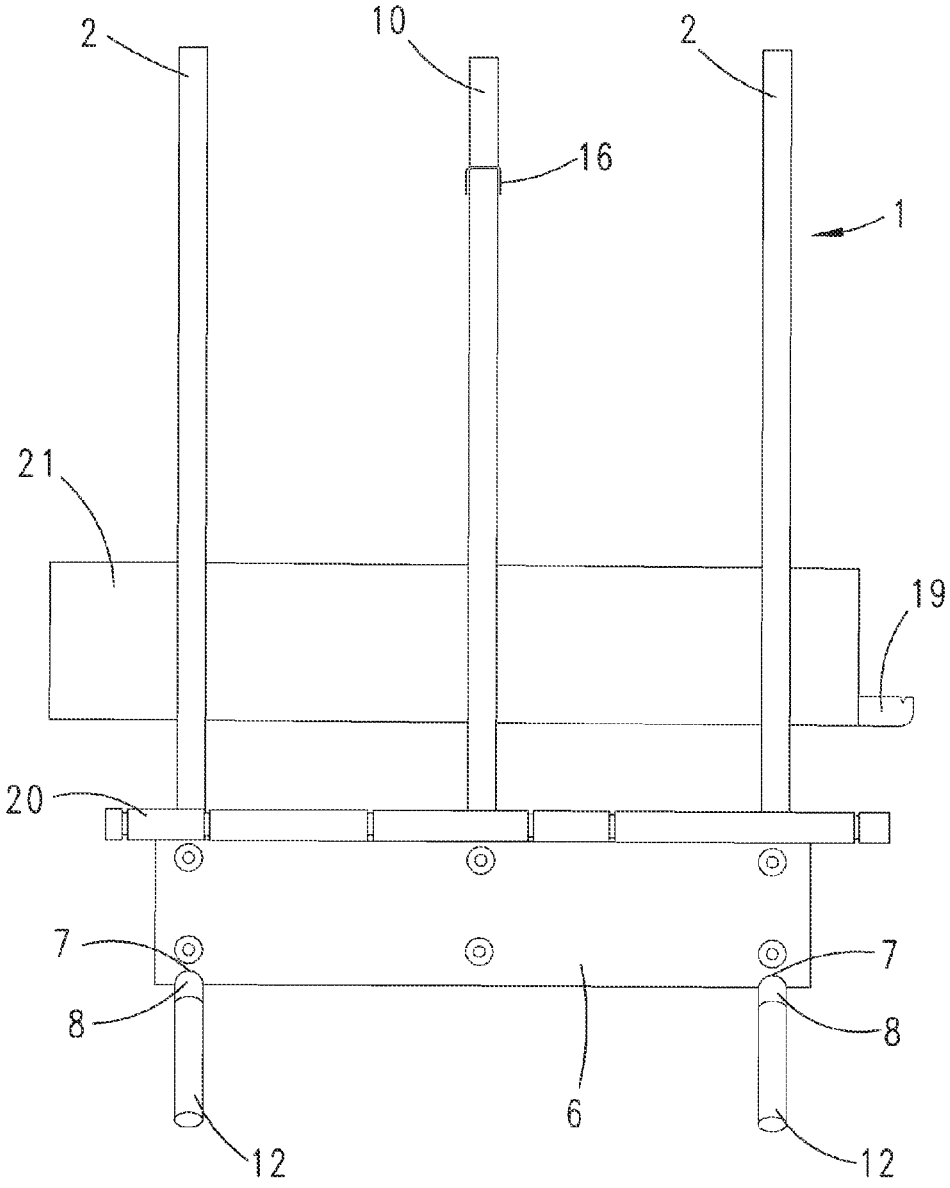
FIG. 4 shows a side view of the saw horse with only one wood log.
Figure 5:
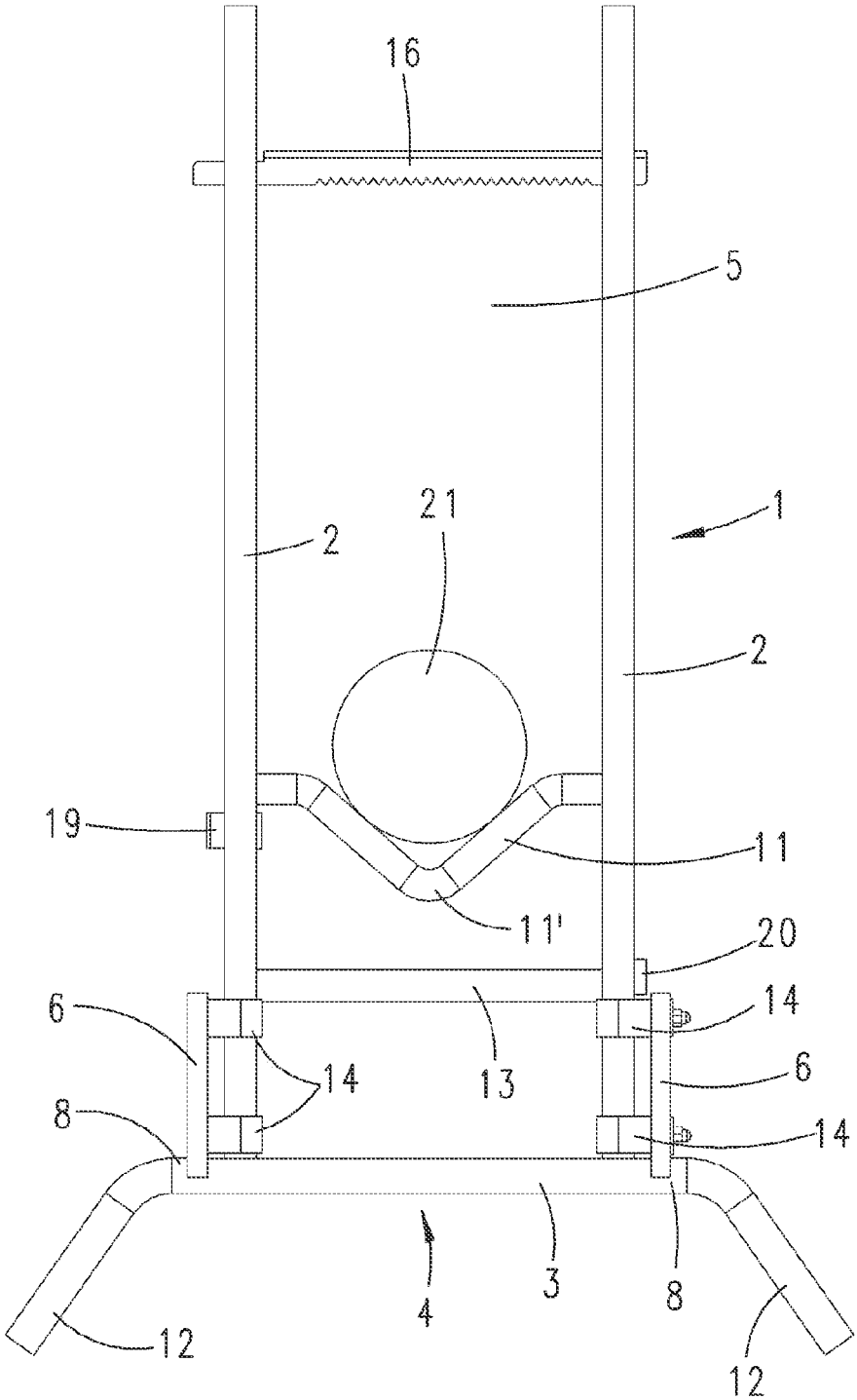
FIG. 5 shows a front view of the saw horse.

If only one wood log is placed in the interspace 5, as illustrated in FIGS. 4 and 5, the wood log 21 lies on the two side flanks of the V-shaped structure 11' of the support bar 11.

A multiplicity of wood logs situated in the interspace 5 may be simultaneously cut to length using the device. Scales 19, 20 are provided for finding the correct measure for the length of the wood logs to be cut to length. The scales extend parallel to the connecting elements 6, and may be displaced in the vertical direction. For this purpose, the scales 19, 20 may be clipped to the vertical braces 20, which have a circular cross-section.

The articulated joints 14, 15 have a simple design. The articulated joint socket is formed by a tube piece or a clip, which is screwed at the inwardly facing side of the connecting element, this preferably being formed by a wooden board. The articulated pivot pins are formed by the vertical braces 2, 10 themselves, which have a circular cross-section. The downwardly pointing end faces of the vertical braces 2 are butt-welded to the horizontal brace 3. The downwardly pointing end of the vertical brace 10 may be thickened so that the connecting element is carried along upwardly when the element 9 is lifted up. The vertical brace 13 is located directly above the axially fixed articulated joints 15 in order to provide axial strength in the other direction. As a result, the detent 7, 8 cannot be overcome when the support bar 11 of the retaining element 9 is under load from wood logs, as illustrated in FIGS. 3 through 5.

Figure 3:
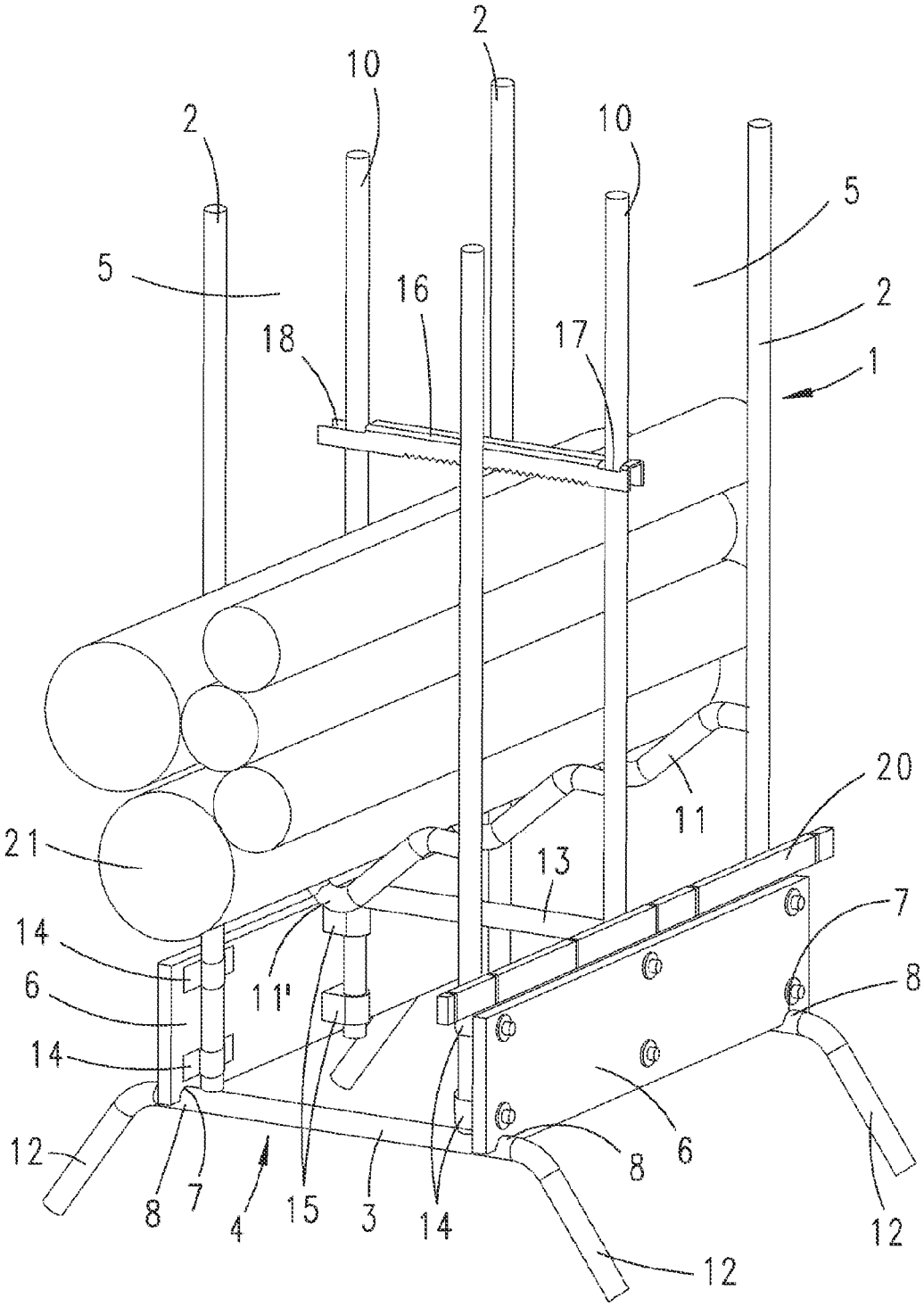
FIG. 3 shows another perspective illustration, with wood logs stacked inside the interspaces between the vertical braces.

The support bars 11 and in particular the lowermost regions 11' of the support bars 11 are located at a sufficient distance from the upper edge of the connecting elements 6 so that the multiplicity of wood pieces 21 illustrated in FIG. 3 may be split up from top to bottom in the region between the stand element and the retaining element, using a chainsaw. After the lowermost piece of wood 21 has been cut through, there is sufficient further space for the saw blade to move into.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application.

The invention claimed is:

1. Saw horse having at least two stand elements, each stand element having a base and two vertical braces which are arranged to leave an interspace for accommodating a piece of wood, and which project upwardly from the base, a retaining element being arranged between the two stand elements and having two vertical braces, the vertical braces of the stand elements and the retaining element have free ends that are not connected together so that the vertical braces of the stand elements and the retaining elements form a fork-shape, support bars are provided to connect the vertical braces of the respective stand elements and retaining element, the wood being placeable on the support bars, wherein two parallel connecting elements are provided so that one of the connecting elements connects together one of the vertical braces of each of the stand elements and one of the vertical braces of the retaining element, and another of the connecting elements connects together another of the vertical braces of each of the stand elements and another of the vertical braces of the retaining element so that the interspaces between the vertical braces of the two stand elements and the retaining element are aligned with one another in an operating position, wherein the connecting elements are pivotably secured to the vertical braces of the stand elements and the retaining element so that the connecting elements pivot about longitudinal axes of the vertical braces so that the saw horse may be folded up in a parallelogram manner, in plane view, from its operating position, in which the connecting elements are spaced at a maximum distance from one another, into a storage position in which the connecting elements are spaced at a minimum distance from one another.

2. Saw horse according to claim 1 wherein the saw horse is held in its operating position by means of a releasable positive-fit detent.

3. Saw horse according to claim 2 wherein the positive-fit detent is formed by a detent recess in the connecting element and an engagement portion of the base.

4. Saw horse according to claim 2 wherein the positive-fit detent may be overcome by moving the connecting elements upwardly.

5. Saw horse according to claim 1 wherein the support bars bridge, at the same height, the interspace between two vertical braces associated with a each of the stand elements and the retaining element.

6. Saw horse according to claim 5 wherein the support bars extend between the vertical braces of the stand elements or of the retaining element, while forming a substantially V-shaped depression.

7. Saw horse according to claim 1 wherein the base is formed by a horizontal brace which connects the two vertical braces of each stand element to one another, and whose two oppositely facing end portions form support legs.

8. Saw horse according to claim 1 further comprising a hold-down element which crosses the interspace, is mountable on one of the vertical braces, and, by tilting thereon, is constrained against movement.

9. Saw horse according to claim 1 further comprising a scale which extends parallel to the connecting element.

10. Saw horse according to claim 5 wherein the vertical braces, the horizontal braces, and the support bar are formed by tube elements.

11. Saw horse according to claim 1 wherein the connecting elements are formed by wooden boards that have axially movable articulated joints and axially fixed articulated joints.

12. Saw horse according to claim 9 wherein the scale is situated on the vertical braces in a height-adjustable manner.

13. Saw horse according to claim 1 further comprising a space beneath the support bars and above the connecting elements, into which a saw blade can move.

14. Saw horse according to claim 1, further comprising a hold-down element that extends between the vertical braces of one of the stand elements or the retaining element.

15. Saw horse according to claim 2, wherein each end of one of the connecting elements is rotatably connected to a bottom section of one of the vertical braces by two joints so that the joints are axially slideable whereby the vertical brace is displaceable relative to the connecting element along a rotational axis.

16. Saw horse according to claim 15, wherein the retaining element is connected to one of the connecting elements by two joints that are axially fixed to the connecting element whereby lifting of the retaining element results in lifting of the positive-fit detent and both connecting elements are carried along by upward displacement of the retaining element.

17. Saw horse according to claim 16, wherein pivot pins of the joints are formed by the vertical braces.

* * * * *